US007510538B2

(12) United States Patent
Wolter et al.

(10) Patent No.: US 7,510,538 B2
(45) Date of Patent: Mar. 31, 2009

(54) SHOE WITH ENERGY STORAGE AND DELIVERY DEVICE

(75) Inventors: Dietmar Wolter, Hoisdorf (DE); Fabian Wolter, Hoisdorf (DE)

(73) Assignee: Dietmar Wolter, Hoisdorf (DE)

( * ) Notice: Subject to any disclaimer, the term of this patent is extended or adjusted under 35 U.S.C. 154(b) by 481 days.

(21) Appl. No.: 10/487,292

(22) PCT Filed: Aug. 19, 2002

(86) PCT No.: PCT/DE02/03048

§ 371 (c)(1),
(2), (4) Date: Sep. 30, 2004

(87) PCT Pub. No.: WO03/018141

PCT Pub. Date: Mar. 6, 2003

(65) Prior Publication Data

US 2005/0034327 A1 Feb. 17, 2005

(30) Foreign Application Priority Data

Aug. 23, 2001 (DE) ..... 101 40 377

(51) Int. Cl.
*A61F 5/00* (2006.01)
*A43B 13/28* (2006.01)

(52) U.S. Cl. ..... 602/28; 602/27; 36/27

(58) Field of Classification Search ..... 36/27, 36/158; 602/27, 28, 29, 23, 32; 482/79, 482/124

See application file for complete search history.

(56) References Cited

U.S. PATENT DOCUMENTS

| | | | | | |
|---|---|---|---|---|---|
| 2,439,100 | A | * | 4/1948 | Richards | 602/28 |
| 2,567,195 | A | * | 9/1951 | Ellery | 602/28 |
| 3,086,521 | A | * | 4/1963 | Desai et al. | 602/16 |
| 4,371,161 | A | * | 2/1983 | Williams | 482/79 |
| 5,291,904 | A | * | 3/1994 | Walker | 128/882 |
| 5,685,830 | A | * | 11/1997 | Bonutti | 602/16 |
| 5,860,423 | A | * | 1/1999 | Thompson | 128/882 |
| 6,110,078 | A | * | 8/2000 | Dyer | 482/79 |
| 6,193,225 | B1 | | 2/2001 | Watanabe | 267/180 |

FOREIGN PATENT DOCUMENTS

| | | |
|---|---|---|
| DE | 27 01 894 | 7/1978 |
| DE | 101 07 824 C1 | 1/2003 |
| WO | 96/32028 | 10/1996 |
| WO | 99/55185 | 11/1999 |

* cited by examiner

*Primary Examiner*—Jila M Mohandesi
(74) *Attorney, Agent, or Firm*—Vidas, Arrett & Steinkraus, P.A.

(57) ABSTRACT

According to the invention, a shoe having at least one base spring element, which is arranged between appendages at a heel zone of the shoe and at a shaft zone taking support at the front edge of the shin bone and which stretches in the course of an ambulation phase, characterized in that a tensioning assembly moves the appendage of the base spring element at the heel zone away from the appendage at the shaft zone upon planting of the shoe, for stretching of the base spring element.

13 Claims, 5 Drawing Sheets

SHOE WITH ENERGY STORAGE AND DELIVERY DEVICE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

The present invention relates to a shoe having at least one base spring element, which is arranged between a heel zone of the shoe and a shaft zone supporting on the cnemial front edge and which expands during a stepping phase.

A shoe of this general type is the object of the as yet unpublished German patent application 101 07 824 2-26 of the applicant of the present invention. According thereto, the shoe is able to store the energy of the momentum that is attained when the shoe is set down in the course of a step and which can release it as efficiently as possible for repelling the foot during a subsequent stepping phase.

The object of the present invention is to further improve the aforesaid effect in a shoe of storing the energy of the momentum attained in the shoe when set down in the course of a step and again releasing it as efficiently as possible for repelling the foot during a subsequent stepping phase.

In the animal kingdom it can be observed that in large running birds—in particular in the stork species—with each step a part of the impact energy is stored in the long tendons so that with the next step it can be again returned. This economical system in nature is not restricted to the large running birds; it is merely particularly obvious in this case. It must rater be assumed, that the tendons and muscular elements of the body in the higher evolved species fulfill the task not only of developing and transmitting power but also the task of storing and returning energy.

It is well known that there is a static load transferring system in the body. In this context this is represented by the sections of the skeleton, including the articulations. In addition, our own studies have shown that there is also a dynamic power developing and load transmitting system. This involves the musculature and the tunica muscularis (fasciae) as well as the tendons, vessels and nerves.

This system, which can also transmit load like bone, has energy storage and release as its third important task.

In virtue of the bones it is not only a question of transfer of an operating force but rather in its structure it represents an element of elasticity, which also stores operating forces partially in its structure so that it can the be released.

If one considers the structure of the foot and the adjacent bones and muscle components, then the following can be established:

At the sole of the foot, impact and pressure zones can be differentiated. Accordingly, the heel represents the essential impact zone. Here upon impact, the major part of the energy is introduced into the osseous system. An artificial storage and release of the energy can occur here as is described in some of the cited patents, through resilient heel constructions. This is only minimally efficient.

In the zone of the forefoot the balls of the foot likewise represent an impact zone. They assume this function when running on the forefoot, but also during the heel-to-toe walking. Here, the operating energy is not only transmitted into the skeletal components. Rather, in virtue of the expansion of tendon and muscular structures, that lie in the longitudinal and transverse sense under the arch of the foot (the so-called plantar aponeurosis), it results in a spring suspension and also in storage of the operating energy in the structures.

In this regard it results especially in an expansion of this tendon plate in the sole of the foot in a transverse direction under the transverse arch of the foot and in the longitudinal direction under the longitudinal arch of the foot. In addition, there is an expansion of the Achilles tendon as well as the muscles that are connected to the Achilles tendon (the suralis and the soleus muscles). Because these muscles in part act via the knee joint on the thigh bones, the entire let is consequently involved in the energy storage. Upon continuing the step, the energy is converted back again into appropriately directed forces, which relievingly support the motor function of the musculature in their force generation.

Upon pushing off, the tendons are relieved and the energy of the stored energy is transmitted into the following step.

Three phases can be differentiated: The first phase results in an elongation and stretching of the tendon structure. This elongation of the corrugated collagen fibers results in a stretching of the fibers. If the stretching is achieved, the fibers cannot be further elongated, which means that then the muscle force is transmitted directly (second phase). The third phase is characterized in that in the next step, at the end, the stored energy, by relieving the tendon structure, is fed back into the new step.

The Achilles tendon and the muscles attached to it as well as the long tendons of the flexors and extensors of the toes and the mid-foot also work according to this principle of energy storage. In a walking or running process, this results in a stressing of these long, cross-articulation tendons and muscle structures. The biasing is transmitted together with the operative muscle force into the next step.

This physiological basic concept is translated according to the invention, in that at least one base spring element is affixed between the heel zone of the shoe and the shaft zone at the cnemial front edge—e.g. minimally biased. The appendage of the base spring element in the zone of the shoe is, according to the invention, upon setting down the heel, moved away from its second appendage on the shaft zone for extension of the base spring element, and especially preferably rearwardly and/or downwardly. The makes possible firstly a greater lever arm for reinforcing the effect according to the invention of the energy storage and release. Secondly, the movement of the tensioning device, already on its own, operates an extension, which advantageously supplements the extension operated by the flexing of the foot during a step.

BRIEF SUMMARY OF THE INVENTION

According to the invention, the tensioning device can be formed—e.g. in virtue of a rocker with a pivot point—preferably in the rear heel zone, whose one member extends spike-like rearwardly and at which the base spring element rests and whose other rocker member extends forward and pedal-like from the sole of the shoe, projecting downward. Now, if the shoe is placed on the floor during a step, it urges the pedal-like member against the sole and accordingly the second rocker member according to the invention downward and thus stretches the base spring element.

An alternative embodiment resides in a folding gate type member having a pedal-like folding member configured similar to the second rocker member, which operates the folding gate type member extending spike-like rearwardly, using the appendage for the base spring element at its rear end, in such a fashion that the member elongates rearwardly and accordingly stretches the base spring element.

A further alternative embodiment resides in a member extending spike-like rearwards in the form of a pneumatic or hydraulic cylinder with the appendage for the tension element, which can be pneumatically or hydraulically extendably operated and which communicates with a pressure chamber via a fluid line. The pressure chamber is then arranged under the sole of the shoe, so that setting down of the shoe on the floor during a step has the effect that pressure from the pressure chamber acts upon the piston and accordingly the piston is extended. Accordingly, the member is elongated rearwardly and/or downwardly and so stretches the base spring element.

In order that the assembly according to the invention remains in the stretched position during the heel-to-toe movement of the shoe, so that, according to the invention, upon pressing the forefoot, the stored energy is transformed into a "forward propulsion", the shoe according to the invention preferably has a holding device, which holds the tension device and there especially the appendage of the base spring element in the stretched position, as long as certain zones of the shoe rests on the floor. Preferably, the holding assembly holds the position until the heel-to-toe movement is completed over the forefoot and there a pressing of the foot on the floor occurs. This is especially advantageous, when the mechanism for operating the tensioning assembly is arranged, for example, in the heel zone of the shoe, and this heel zone is again removed from the floor during the continued heel-to-toe movement, so that—without the preferred holding assembly—the tensioning assembly would move back, as soon as the heel is again removed from the floor during the heel-to-toe movement.

The holding assembly can be configured as a clamping strip, which is guided in a pocket under a front zone of the sole of the shoe. The clamping strip is then connected with the pedal-like member, for example, and holds it in the stretched position on the sole in that the clamping strip is urged into the pocket by pressing the pedal-like member and the pocket, during sole zone's contact with the floor the clamping strip is clamped in said position by the pressure by the contact with the floor.

The holding assembly can have a valve for the pneumatic or hydraulic tensioning assembly, which then also maintain the pressure, when the pressure chamber is no longer under pressure after contact with the floor is completed. The pressure can then be released again, for example, by means of a suitable switch, which can be situated in a front zone of the sole, for example, and the valve appropriately actuated at the aforesaid time, for example, when the foot in the next step is no longer in contact with the floor.

In virtue of the fact that, in the system between the shin and the heel (from above to below: shin via the ankle joint to the heel bone) the series of bones already forms a concatenation of support elements and the expansion of the base spring element at the time of planting of the forefoot during ambulation is supported (the associated "lifting" of the tip of the foot and simultaneous removal of the rear end of the foot (heel) as an appendage point of the base spring element from its other appendage point at the front edge of the shin bone) by these bones, an artificial support element, which is integrated into the shoe, can also be eliminated. But even an additional support of this stretching via an artificial support element between the appendage point of the base spring element at the heel and the appendage point of the base spring element at the front edge of the shin bone is in accordance with the invention.

The maximum direct anchoring on the bones is achieved at the front of the lower leg. Here, the shin bone front edge lies directly under the skin.

In order to optimize the introduction of the force from the tensioned spring element into the foot, preferably in the zone of the back of the forefoot, it is preferable to implement a satisfactorily, preferably anatomical, part therein. This part can then preferably be permanently connected with the shoe sole in the corresponding zone, e.g. by means of a belt, in order to transmit the impact force, which issues from the sole, as effectively as possible into the foot.

Natural collagen fibers which also comprise the tendons and ligaments in the human body, are elastic as has already been described. Furthermore, they have the characteristic of not being linearly elastically deformable but deform in the area of lesser expansion with lower elastic force (thus "easier") and in contrast, in the zone of greater expansion, they operate an over-proportionally great elastic force (they are thus "more difficult" to deform). This non-linear elasticity of the natural tendons and ligaments consequently effects firstly the already described effect of energy storage and energy release and secondly prevents the destruction of structures because of excessive stretching. This feature is preferred in accordance with the invention for the base spring element, which then expands elastically preferably up to a constructively pre-defined or even adjustable degree (for energy storage and release) and which "opposes", however, with increased rigidity further expansion upon greater stretch. In this zone, then, the flexing of the foot is limited by the greater rigidity of the base spring element and effects, in corresponding configuration, that the force introduced into the floor from the foot is used essentially only for pressing and consequently for "advance propulsion" of the foot.

This non-linear elasticity of the base spring element can be effected in different ways in accordance with the invention For example, the base element can be manufactured out of a material with corresponding non-linear elastic deformational behavior. Or the base spring element is comprised of elastic fibers, which determine the minimum rigidity in the zone of the lesser stretching while "parallel", but initially unstressed, rigid fibers (e.g. carbon fibers) running in sinuous lines ultimately stretched in greater stretch limit further stretch. These two fiber types can run separately from one another or together embedded in a matrix to form a band.

The rigidity of the base spring element can be adjusted to be different from the respective function (sports, routine, impaired) or to the individual situation. Gliding during the stretch of the preferably longitudinal, loosely flexible structure of the base spring element can accordingly be facilitated by means of sleevelike structures (such as the natural tendon sheaths), in order to maximally prevent energy loss, which can occur due to friction. A padding at the contact points, especially at the shin bone, also to make possible a larger areas of force induction by means of the skin, is preferred. Accordingly, the contact points can have an adjusting piece formally adapted to the front edge of the shin bone, which can be integrated into the shoe shaft, for example. However, it can also—e.g. in order to position the appendage point on the front edge of the shin bone as far as possible upwards in the direction of the knee—be integrated in a sleeve, for example, and the appendage point on the front edge of the shin bone s then supported by means of the support element downwards towards the shoe and there supported in particular in the heel zone.

The support element according to the invention, as indicated, can be configured in one piece—also in sandwich construction—as a curved plastic part. But even a design comprised of articulated support pieces arranged in a consecutive series, for example, and which take support on each other in an external sleeve, conforms to the invention. This external sleeve can, for example, form the sole itself, in which pieces are then imbedded in the plastic material, for example, comprising the sole. In order to improve the sole contact, an individual anatomical surface design of the inner sole is preferred.

For further development of the invention, including the object of the application, to which this supplemental application refers, it is preferable to integrated the assembly elements in a sole insert of the shoe.

In order not to "waste" energy for compensatory movements, the sole of the shoe according to the invention is preferably provided with suitable structures for improving surface grip and impact damping. For improving surface grip profile corrugations in the underside of the shoe sole, but also "spikes" or "cleats" are suitable, which can even be replaceable. For damping purposes, for example, elements, whose material properties effect a specific damping and which can also be replaced with elements having other damping characteristics for adjustable adaptation of the damping relationship are suitable.

BRIEF DESCRIPTION OF THE DRAWINGS

The present invention will now be more completely described with reference to the appended drawings, wherein.

DETAILED DESCRIPTION OF THE INVENTION

Figure 1A:
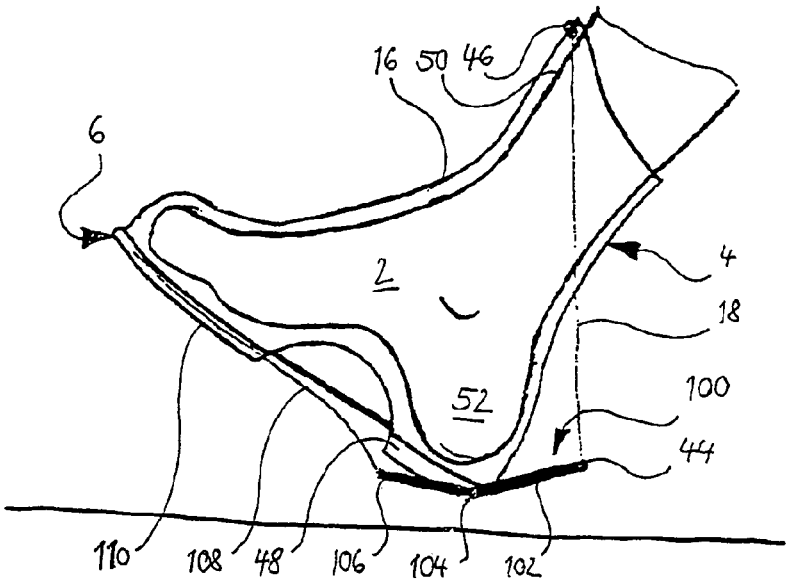
FIGS. 1*a* to 1*c* diagrammatically represent a side view of a foot with an embodiment of a shoe according to the invention in three phases of heel-to-toe movement in the process of a step.

While this invention may be embodied in many different forms, there are described in detail herein a specific preferred embodiment of the invention. This description is an exemplification of the principles of the invention and is not intended to limit the invention to the particular embodiment illustrated FIG. 1 represents a first embodiment of the invention, wherein a base spring element 18 is arranged between the ends 44, 46 of a support element 16, which is integrated into the external shell of the shoe 4. The base spring element 18 and the support element 16 run from a first appendage 44 at the heel zone 48 or the sole 6 to a second appendage 46, which rests on the front edge of the shin bone 50 (represented only extremely diagrammatically). The support element and the osseous support of the lower leg and foot skeletal elements 50, 52, which represents an osseous bridge between the upper end point 46 of the base spring element 18 and the lower end point 44, co-operate in this instance.

Figure 1B:
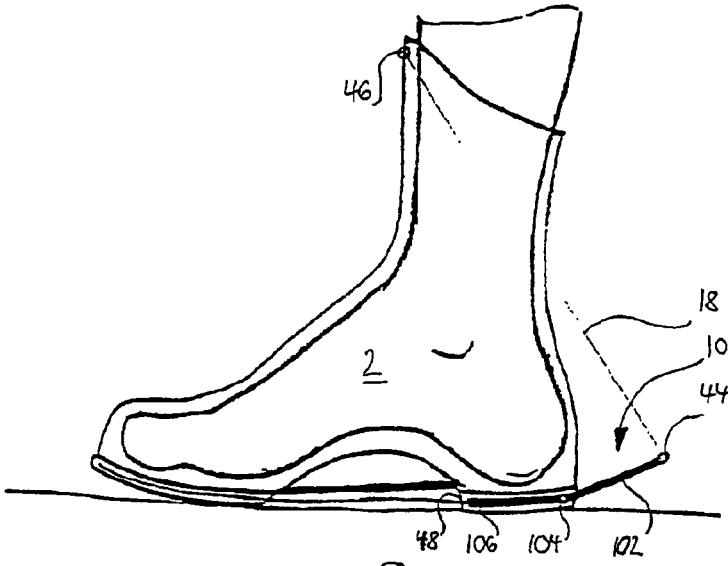
Figure 1C:
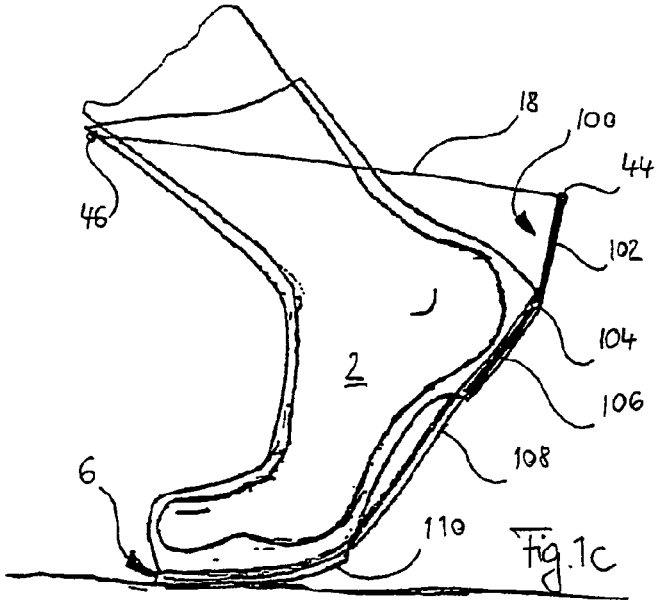

The base spring element 18 is, on the one hand, stretched during the ambulation phase of FIG. 1*b*, in that upon setting down the forefoot 10 on the floor 8, the lower leg 50 tilts forward over the foot and consequently the foot itself flexes towards the lower leg 50. During the subsequent (represented in FIG. 1*c*), ambulation phase, the foot then extends, while the forefoot zone 10 is compressed by the floor 8. In virtue of the back-deformation of the base spring element 18, an impulse is advantageously according to the invention transferred into the floor 8, which advantageously supports the compression of the foot. When this occurs, the belt connection 98 assures that the sole and the foot are securely connected to each other at the time of the compression.

On the other hand, the base spring element 18 stretches in that tensioning assembly 100 moves the appendage 44 downward in the direction of the floor. The tensioning assembly 100 is configured as a rocker with a first rocker member 102, which extends rearwards spike-like in the heel zone 48, and carries the appendage 44 at its end. The second rocker member 106 extends from pivot point 104 forward and projects downward pedal-like from the sole 6 of the shoe 4. As soon as the foot 2 sets its heel 52 and thus its heel zone 48 of the sole 6 of the shoe 4 on the floor (FIG. 1*b*), the rocker 100 pivots the second member 106 into the heel zone 48, so that the first member 102 together with its appendage 44 of the base spring element 18 moves away from its second appendage 46. In this fashion, the base spring element 18 is stretched. During the further heel-to-toe movement according to FIG. 1*c*, the rocker 100 is held in this position (so that the energy stored in the base spring element 18 becomes effective upon pressing the forefoot after said ambulation phase and the forward propulsion is increased (in that a clamp strip 108 is applied at the second rocker member 106, which extends forward into a pocket 110 under the front zone of the sole 6. The clamp strip 108 is inserted thereinto opposite to the position represented in FIG. 1*a* and is clamped in the pocket 110 by the pressure of the foot 2 on the floor.

Figure 2A:
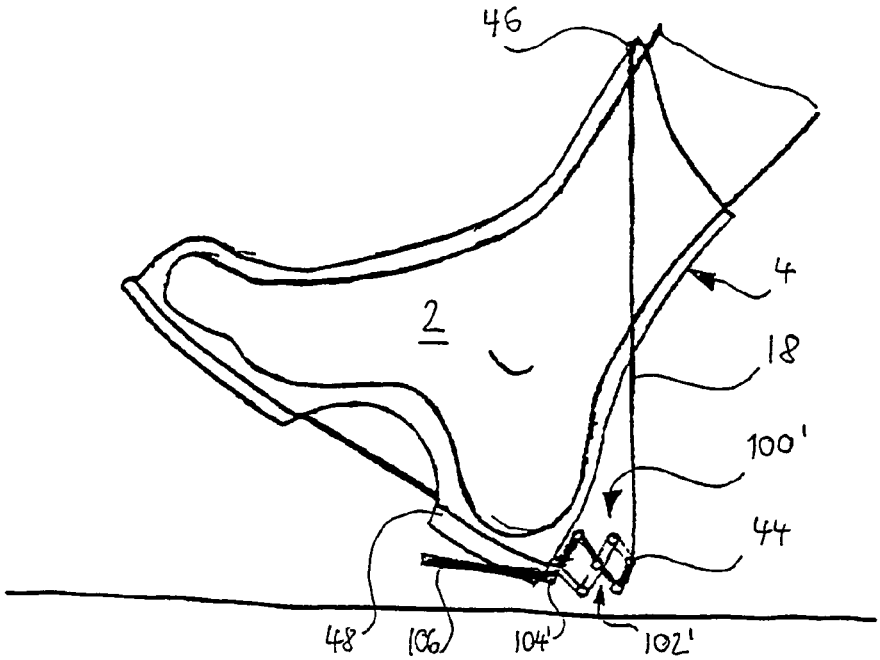
FIGS. 2*a* and 2*b* diagrammatically represent a side view of a foot with an alternative embodiment of a shoe according to the invention in two phases of the heel-to-toe movement of a step.
Figure 2B:
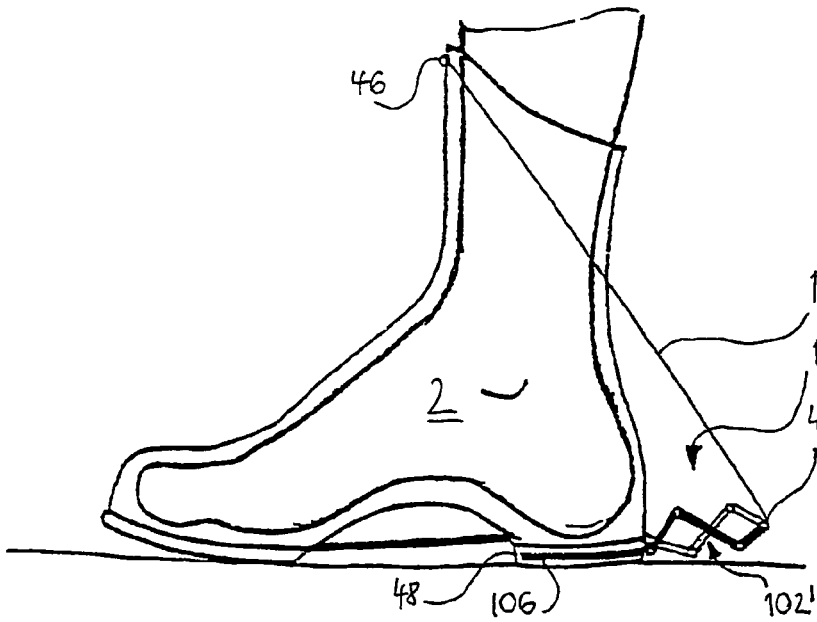

FIG. 2*a* and 2*b* represent an alternative embodiment of a tensioning assembly 100' in the ambulation phases of the foot 2 according to FIG. 1*a* and 1*b*. The tensioning assembly 100' has a folding grate member 102', which extends spike-like from the heel zone 48 of the shoe 4 rearwardly and at its end carries the appendage 44 of the base spring element 18. A folding member 106 of the folding gate member 102' extends from its point of articulation 104' at the rear end of the heel zone 48 pedal-like forward and projects downward from the heel 48. Accordingly, it corresponds in its configuration and function to the front rocker member 106 according to FIG. 1.

Figure 3A:
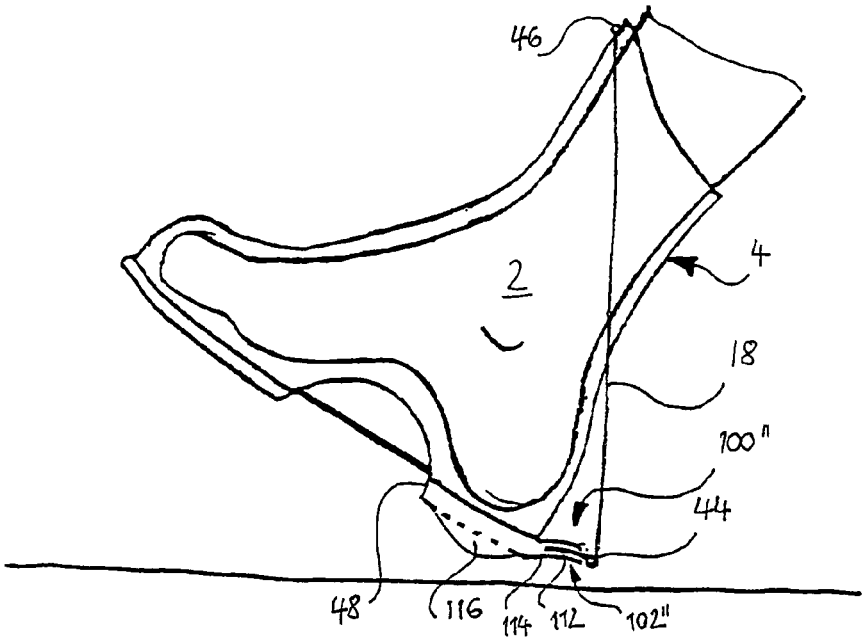
FIGS. 3*a* and 3*b* diagrammatically represent a side view of a foot with a further alternative embodiment of a shoe according to the invention in two phases of the heel-to-toe movement of a step.
Figure 3B:
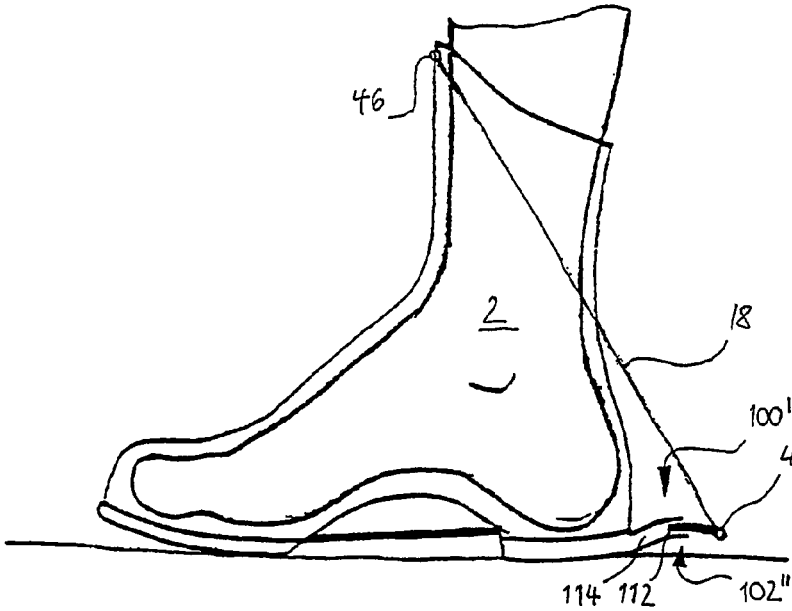

As a further alternative embodiment, FIG. 3*a* and 3*b* also represent a tensioning assembly 100" in the two ambulation phases according to FIG. 1*a* and 1*b*. The tensioning assembly 100" according to FIG. 3*a* and 3*b* has a member 102", which is formed by a hydraulic piston 112, at whose rear end the appendage point 44 of the base spring element 18 is arranged and which extends into a cylinder 114. The cylinder 114 is filled with a hydraulic fluid and communicates with a line with a pressure chamber 116, whose elastic wall expands downward from the heel 48. As soon as the heel 48 according to FIG. 3*b* is planted on the floor, the pressure chamber 116 is compressed and assures that the piston 112 travels out of the cylinder 114 rearwardly and so stresses the base spring element 18.

Figure 4A:
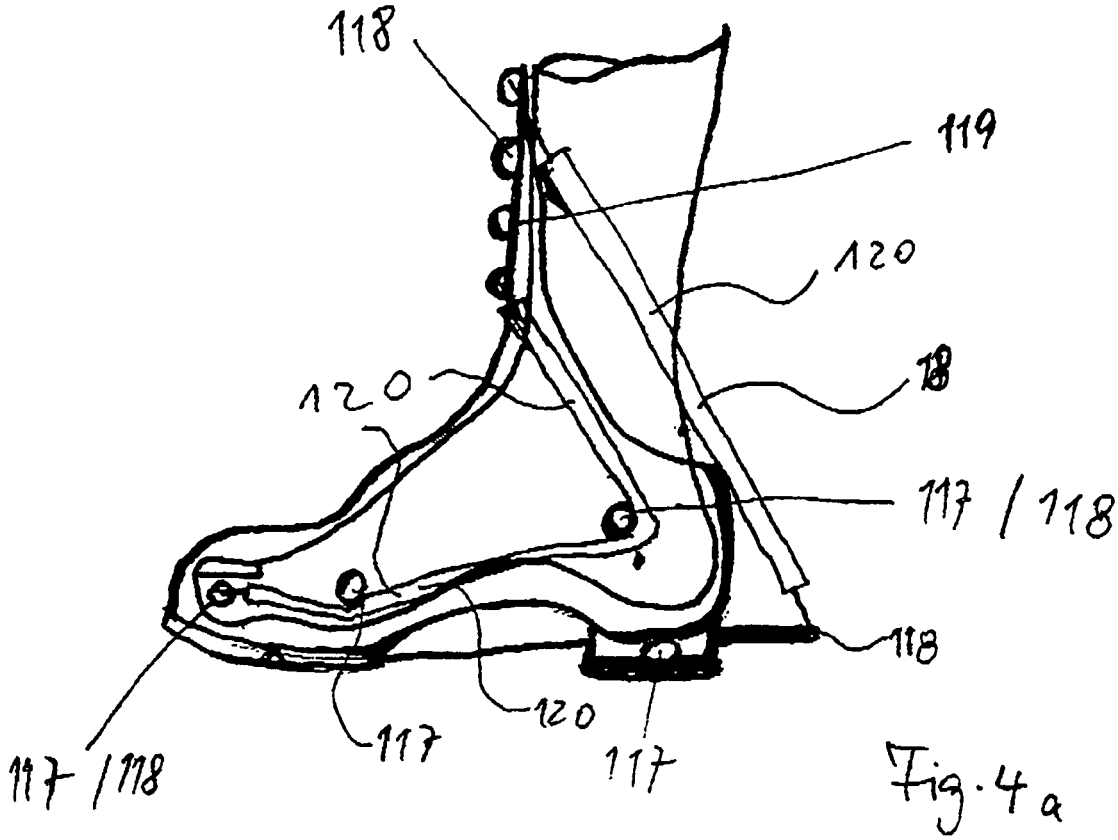
FIGS. 4*a* to 4*d* diagrammatically represent a side view of a foot with a further alternative embodiment of a shoe according to the invention with base spring elements applied externally on the sides in an overall view and detail exploded view.
Figure 4B:
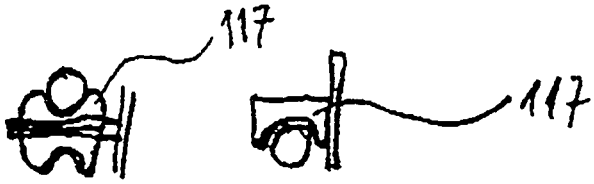
Figure 4C:
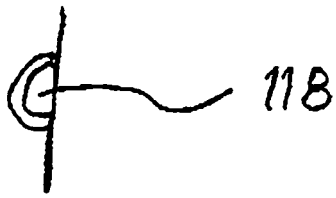
Figure 4D:
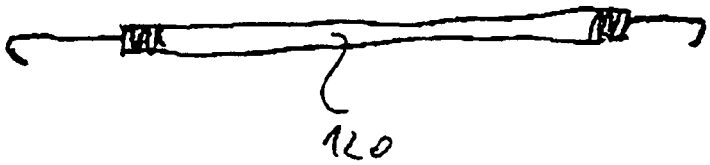
Figure 5:
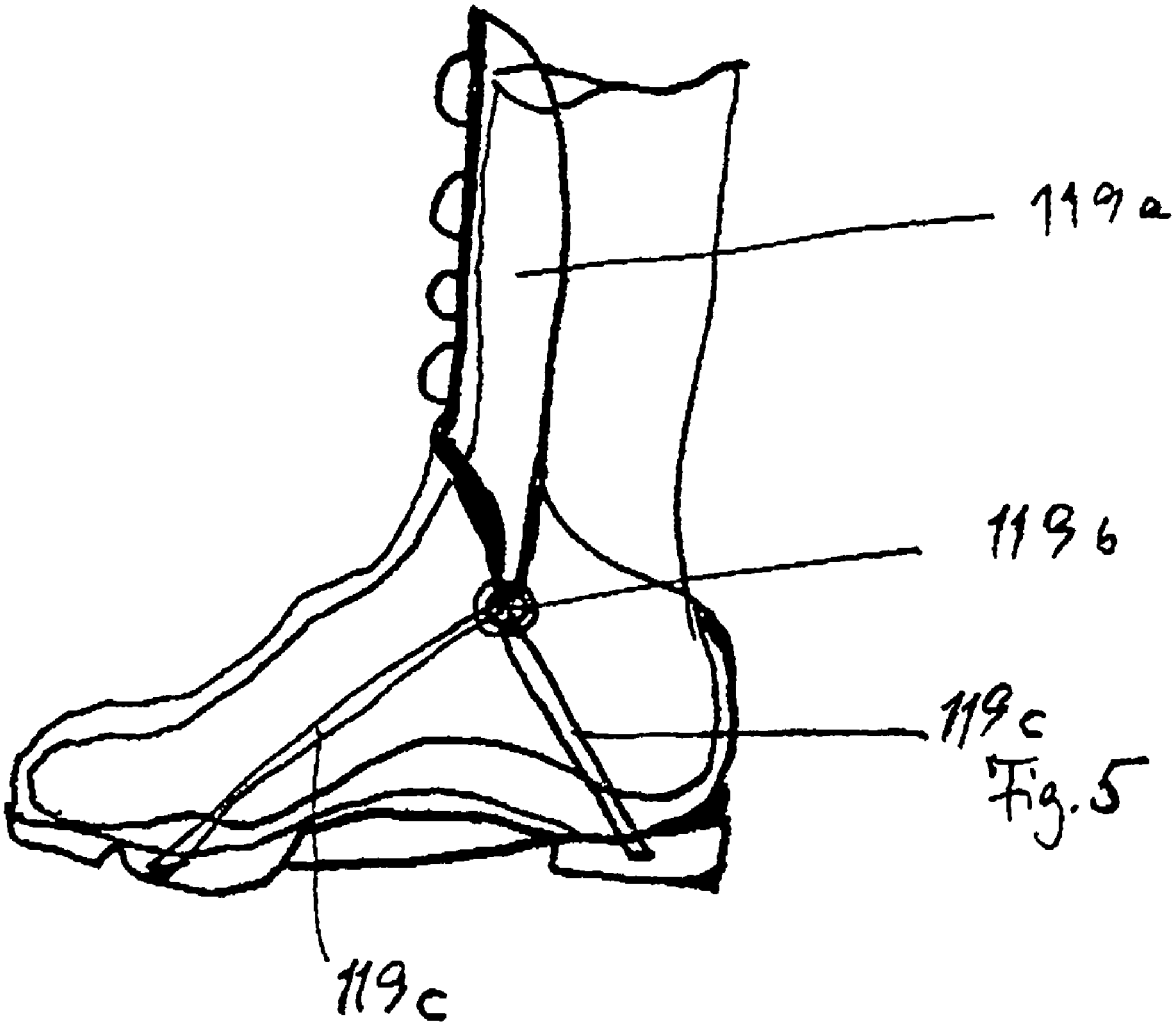
FIG. 5 represents a further embodiment as a modification of FIGS. 4*a* to 4*d*.

The elastic elements 18 can also be arranged on the outside of the shoe and vice-versa. According to FIG. 4*d*, for example, the spring element 18 comprises a rubber element with a rounded cross-section (rubber cable), which has metal hooks at its ends (120). This spring element (120) is fastened to grommets (118, FIG. 4*a* and 4*c*). An alternation is done by means of rollers or elements, that have a groove for guiding the round rubber cable (117, FIG. 4*a* and 4*b*). The spring elements 120 can, for example, be replaced at any time with stronger or weaker ones. A solid part 119 adapted to the shin bone front edge serves as the counter-bearing of the rubber cable. The grommets 118 can be arranged on the Part 119 in the middle, but also laterally farther back (dorsally). In order to assure that this part does not shift, its grommet carrier 119*a* is affixed according to FIG. 5 using an articulation 119*b* and supports 119*c* to the heel and sole of the foot.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A shoe having at least one base spring element (18), which is arranged between appendages (44, 46) at a heel zone (48) of the shoe (4) and at a shaft zone (46) supported at the front edge of the shin bone (50) and which stretches during a phase of ambulation, characterized in that a tensioning assembly (100, 100', 100"), which moves the appendage (44) of the base spring element (18) at the heel zone (48) upon planting of the shoe (4) for stretching of the base spring element (18) away from the appendage (46) at the shaft zone, and further wherein the appendage (44) is positioned on a first rocker member (102), extending rearwards from the heel zone.

2. The shoe according to claim 1, wherein the tensioning assembly (100) has a rocker (100), whose pivot point (104) is arranged in the heel zone (48), and having the first rocker member (102) extending from the pivot point, rearward, at which the base spring element (18) is supported and having a second rocker member (106) extending from the pivot point forward, which projects downward from the sole (6) of the shoe (4).

3. The shoe according to claim 1 wherein the tensioning device (100') has a folding grate member (102'), which extends spike-like rearwardly from the heel zone (48) and at which the base spring element (18) is supported, having a folding member (106') extending forward, which projects pedal-like downward from the sole (6) or the shoe (4).

4. The shoe according to claim 1 wherein the tensioning assembly (100") has a member, that extends spike-like from the heel zone (48) rearward and is supported on the base spring element (18) and which operated hydraulically or pneumatically can be elongated rearward by means of a pressure chamber (116) arranged under the shoe (4), which is placed under pressure upon setting down the shoe (4).

5. The shoe according to claim 1, wherein a holding assembly (108, 110) holds the appendage (44) in the moveable position during contact of the shoe (4) with the floor.

6. The shoe according to claim 4 wherein the holding assembly has a valve for maintaining the pressure.

7. The shoe according to claim 5, wherein the holding assembly has a clamping strip (108), which engages at the tensioning assembly (106), and a pocket (110) under a forward sole zone (6) of the shoe (4), in which the clamping strip (108) is clamped in the distanced position during the contact of the sole zone (6) for holding the tensioning assembly (100).

8. The shoe according to claim 5, wherein the base spring element (18) has a supporting member (16) between the appendage (44) at the heel zone (48) of the shoe (4) and the appendage (46) at the shaft zone.

9. The shoe according to claim 5, wherein the shaft zone has an adjusting piece adapted to the front edge (50) of the shin bone.

10. The shoe according to claim 5, wherein the base spring element (18) is guided longitudinally and flexibly in a sleeve.

11. The shoe according to claim 5, wherein the elastic rigidity of the base spring element (18) is enlarged upon greater stretching.

12. The shoe according to claim 5, wherein the supporting element (16) is comprised of articulated support pieces.

13. The shoe according to claim 5, wherein the support element (16) is flexibly elastically deformable.

* * * * *